United States Patent [19]

Schirmer

[11] Patent Number: 4,815,602

[45] Date of Patent: Mar. 28, 1989

[54] VACUUM SKIN PACKAGE FOR CLOSING TWO MOISTURE IMPERVIOUS METALLIC SHEETS ABOUT A PRODUCT

[75] Inventor: Henry G. Schirmer, Spartanburg, S.C.

[73] Assignee: W.R. Grace & Co., Duncan, S.C.

[21] Appl. No.: 115,458

[22] Filed: Oct. 30, 1987

[51] Int. Cl.[4] ..... B65D 71/06; B65B 11/52

[52] U.S. Cl. ..... 206/497; 53/427; 53/509; 206/471; 206/484; 229/3.5 MF; 383/113; 383/116; 426/124; 426/126

[58] Field of Search ..... 206/484, 524.8, 471, 206/466, 497, 461, 469, 524.6, 524.9; 426/124, 126; 53/427, 509; 229/3.5 MF; 383/113, 116

[56] References Cited

U.S. PATENT DOCUMENTS

| | | | |
|---|---|---|---|
| Re. 30,009 | 5/1979 | Perdue et al. | 53/433 |
| 2,572,056 | 10/1951 | Salfisberg | 206/484 X |
| 2,833,401 | 5/1958 | Lefebrve | 206/484 X |
| 3,057,128 | 10/1962 | Gerhauser | 206/484 X |
| 3,301,392 | 1/1967 | Regan, Jr. | 206/484 X |
| 3,301,393 | 1/1967 | Regan, Jr. et al. | 206/484 X |
| 3,358,900 | 12/1967 | Perdue | 206/524.8 X |
| 3,756,399 | 9/1973 | Cosier et al. | 206/497 |
| 3,835,618 | 9/1974 | Perdue | 53/112 |
| 3,950,919 | 4/1976 | Perdue | 53/112 |
| 3,966,045 | 6/1976 | Perdue | 206/443 |
| 4,333,601 | 6/1982 | Grimm | 229/3.5 MF X |
| 4,382,513 | 5/1983 | Schirmer et al. | 206/484 |
| 4,410,089 | 10/1983 | Bortolani | 206/633 |
| 4,411,364 | 10/1983 | Friedman | 206/466 |
| 4,537,011 | 8/1985 | Bortolani et al. | 53/509 |
| 4,584,101 | 4/1986 | Kataoka | 426/124 X |
| 4,611,456 | 9/1986 | Gillio-tos et al. | 53/427 |

*Primary Examiner*—Stephen Marcus
*Assistant Examiner*—Bryon Gehman
*Attorney, Agent, or Firm*—John J. Toney; William D. Lee, Jr.; Mark B. Quatt

[57] ABSTRACT

A vacuum skin package, having a peripheral area and a central area, comprises a thermoplastic supporting member; a thermoplastic heat-formed top web sealed to the supporting member in the peripheral area of the package; a first moisture impervious metallic sheet having outer and inner non-heat sealable surfaces; a second moisture-impervious metallic sheet having outer and inner non-heat sealable surfaces; the first and second sheets unbonded to each other and substantially enclosing therebetween a product in the central area of the package; and the product and enclosing sheets disposed between and enclosed by the supporting member and top web, the top web in comunication with the outer non-heat sealable surface of the first sheet, and the supporting member in communication with but unbonded to the outer non-heat sealable surface of the second sheet.

7 Claims, 4 Drawing Sheets

VACUUM SKIN PACKAGE FOR CLOSING TWO MOISTURE IMPERVIOUS METALLIC SHEETS ABOUT A PRODUCT

FIELD OF THE INVENTION

The present invention relates to packaging and packaging methods, and more specifically to packages and packaging methods useful in vacuum skin packaging (VSP) techniques.

BACKGROUND OF THE INVENTION

Vacuum skin packaging is a well known technique for packaging food and non-food products in such a way that a tight fitting, often clear package is provided.

Of particular interest is U.S. Pat. No. Res. 30,009 (Perdue et al) teachig the use of a chamber into which a product to be packaged is brought. The product is supported on an impervious supporting member. A top film is placed over the product, and while in a dome, the top film is brought up against a heated portion of the dome by vacuumization and/or differential air pressure to heat and soften the film, whereupon by release of vacuum and/or vacuumization the heated and softened film drapes over the product and supporting member to form a vacuum skin package.

In the package art, it is sometimes desirable to place a product between two sheets of a material which is not heat sealable under normal operating conditions. An example of such a material is metallic foil such as aluminum foil, which provides excellent moisture barrier properties for a moisture sensitive product, but is not readily heat sealable.

When a product placed between two such sheets is to be enclosed between the sheets, it may be necessary to encapsulate the product and sheets in a larger overwrap. Even in such cases, the seams formed by the two sheets of material may not be substantially closed and some or all of the advantages of the use of such material can be lost.

An alternative to an overwrap is the use of a sleeve or other shaped pouch into which the product and pair of sheets may be disposed. This requires of course additional material, additional processing steps and costs, and can still require the use of an overwrap in order to provide a display container or shipping container for the product.

It has now been discovered that materials which are not readily heat sealable, and which can be used in sheet form to sandwich a product there-between, may be brought together in a substantially closed arrangement by means of the vacuum skin packaging process. At the same time, by the use of such a process, an overall container protects the product enclosed within the sheets, and provides a display container for the product.

SUMMARY OF THE INVENTION

In one aspect of the present invention, a method for packaging a product comprises placing the product to be packaged on a first sheet; placing a second sheet over the product; placing the first sheet, product, and second sheet on a supporting member; applying a top web over the second sheet and in sealing arrangment with the supporting member, by a vacuum skin packaging process; and simultaneously with the application of the top web, bringing the first and second sheets together to substantially enclose the product between the two sheets.

In another aspect of the present invention, a method for packaging a product comprises placing a packet, the packet comprising a first sheet, a product disposed on said sheet and a second sheet disposed over the product, on a supporting member; applying a top web over said packet and in sealing arrangement with the supporting member by a vacuum skin packaging process; and simultaneously with the previous step, bringing the first and second sheet together to substantially enclose the product between the two sheets.

In yet another aspect of the invention, a vacuum skin package comprises a supporting member; a top web in sealing relationship to the supporting member; a pair of sheets substantially enclosing therebetween a product; and the product and enclosing sheets disposed between and enclosed by the supporting member and top web.

BRIEF DESCRIPTION OF THE DRAWINGS

The invention may be further understood by reference to the drawings described below, wherein.

DESCRIPTION OF THE PREFERRED EMBODIMENTS

Figure 1:
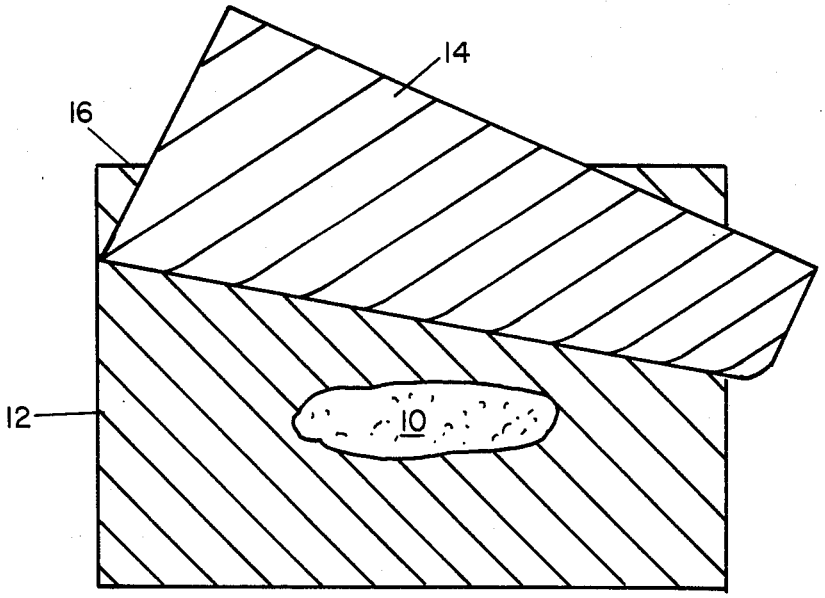
FIG. 1 illustrates a product disposed between two sheets of material.

Referring to FIG. 1, a product 10 is disposed between a first sheet 12 and a second sheet 14. The product may be a food or non-food product.

First film 12 and second film 14 are preferably made up of the same material. Where the product 10 is a moisture sensitive material such as medicaments, first sheet 12 and second sheet 14 are preferably made from a material that has a low moisture transmission rate. Especially preferred materials are metal foils such as aluminum foil. In practice, the product 10 can simply be placed on the first sheet 12, and then a second sheet 14, preferably of about the same dimensions as sheet 12, may be placed over the product and substantially in alignment with the first sheet. It may be useful in some end use applications to create a mechanical seal along at least one adjoining edge 16 of the first and second sheets to facilitate placement of product 10 between the sheets. Although first sheet 12 and second sheet 14 may be heat sealable under normal operating conditions in conventional equipment, an important advantage of the invention is the use of sheet materials which provide advantages such as moisture barrier but are not readily sealable.

Figure 2:
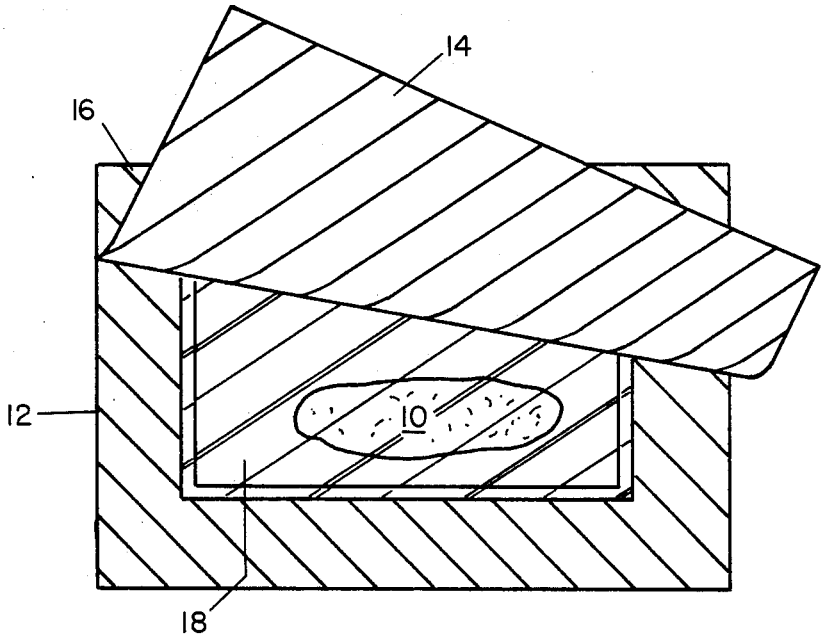
FIG. 2 illustrates an alternate embodiment of FIG. 1 in which the product disposed between two sheets is contained within a pouch.

Referring to FIG. 2, in a alternate embodiment, the product 10 has been prepackaged in a pouch or bag 18 prior to its placement between first sheet 12 and second sheet 14. This alternative can be particularly useful where a product is granulated, powdered, or otherwise difficult to accurately place between first and second sheets, and also where a specific dosage or amount of the material is controlled in a prior packaging step. As with the previous embodiment, one or more edges or portions of adjoining sections of sheets 12 and 14 can be heat sealed or (if not readily heat sealable) mechanically joined prior to placement of the product 10 disposed within pouch 18 onto sheet 12.

Figure 3:
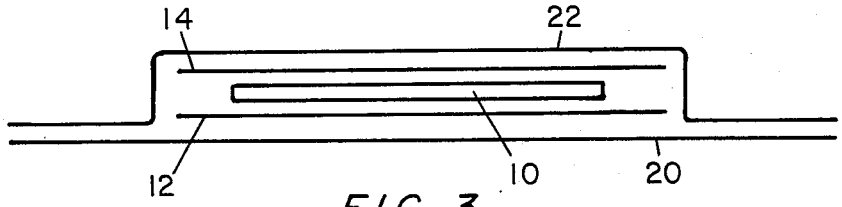
FIG. 3 is a schematic side view of a vacuum skin package in accordance with the present invention.
Figure 4:
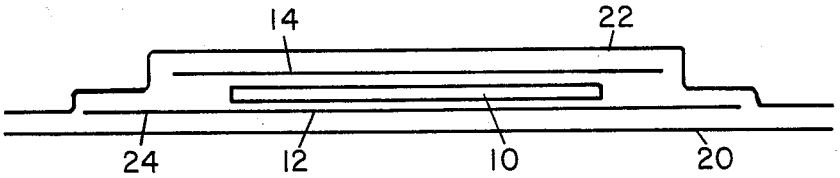
FIG. 4 is an alternate embodiment of a vacuum skin package in accordance with the invention.
Figure 5:
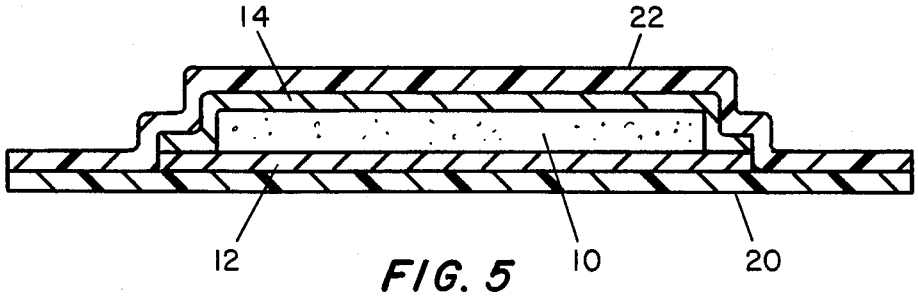
Figure 6:
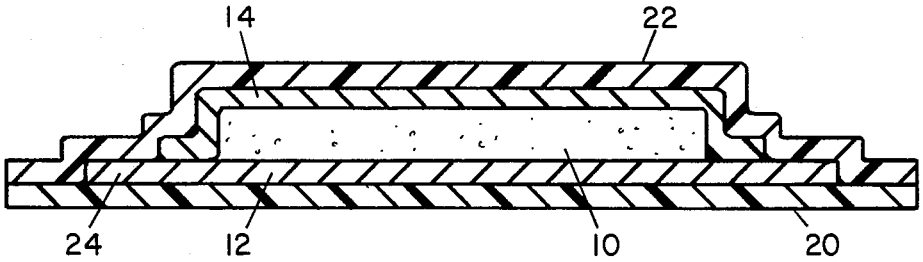

In FIGS. 3 and 4, two alternate embodiments are illustrated showing a schematic side view of vacuum skin packages produced by the inventive process.

Referring to FIG. 3, a product 10 is placed between a first sheet 12 and second sheet 14. The sandwiched assembly which results is in turn placed on a supporting member 20 and passed through a conventional vacuum skin packaging process. Typically, the supporting member 20 carrying the product and first and second sheets is introduced into a chamber of a vacuum skin packaging machine. A top web 22 is placed over the second sheet 14, and then drawn by differential pressure or vacuum up into a heated dome where the top web 22 is heated and softened. Thereafter, by vacuumization and reintroduction of pressure to the top of the top web, the heat and softened material 22 is placed over the second sheet 14 and in sealing engagement with supporting member 20. As this application of the heated material takes place, the first and second sheets are brought together in their adjoining areas around the periphery of the product 10. Additionally, the interior surfaces of sheets 12 and 14 are pressed against the product 10 where they adjoin. In this manner, the product 10 is substantially enclosed between sheets 12 and 14. In some cases, small gaps in the peripheral areas of the sheets may appear between the adjoining sheets, but this may be at least partially offset by the proper selection of materials for supporting member 20 and top web 22. For example, in the case of moisture barrier material such as aluminum foil, the product according to the invention will be substantially enclosed between two sheets of foil. Many factors will determine whether and to what extent the two sheets of foil, after the VSP process, enclose the product. For example, if a mechanical seal had been made along one or more edges of the adjoining sheets, this may affect the degree to which the enclosure of the product is complete. The supporting member 20 can be flexible, semirigid, or rigid, and can be selected for properties to enhance the properties chosen in the sheet materials. In this case, using aliminum foil, a supporting member 20 can be made of material selected for their moisture barrier characteristics. In like manner, top web 22 can be chosen with the view of incorporating appropriate moisture barrier or other desired characteristics in the top web to enhance the selected properties of sheets 12 and 14.

A particular advantage of the present invention is that a dust cover and integral package is provided while at the same time substantially enclosing the product between sheets of material which may or may not in themselves be readily heat sealable. Additionally, transparent materials may be chosen for top web 22 and/or supporting member 20 to provide an aesthetically attractive package in which the enclosed contents can be seen. Of course, sheets 12 and 14 may comprise either transparent or semitransparent or opaque materials.

In an alternate embodiment, in FIG. 4, first sheet 12 is greater in length, in at least one dimension, than the second sheet 14. Preferably, first sheet 12 is greater in both dimensions than second sheet 14. As can be seen from the drawing, this approach permits the top web 22, after it has been heated and softened, to envelope not only the top of second sheet 14, but also an extended portion 24 of first sheet 12. This serves to enhance the enclosure of the product between the sheets, by allowing the VSP top web 22 to in effect seal off possible gaps between the sheets after the VSP process has been completed. In particular, it serves to inhibit the undesirable flow of gases or water vapor between the space between supporting member 20 and the bottom surface of first sheet 12, and the product. By the same mechanism, it also inhibits the transfer of moisture vapor and gases between the outside environment, through the supporting member 20 and the product. This is especially true in the case of supporting member 20 which does not have significant barrier characteristics.

Of course, an additional pouch 18 to prepackage the product before placement between sheets 12 and 14 can be used in connection with the packages of FIGS. 3 and 4. To obtain the effect of moisture barrier or other characteristics inherent in sheets 12 and 14, the pouch 18 should preferably be smaller in both length and width than the sheets.

While the above invention has been described with respect to moisture barrier materials, other materials such as paper can be also effectively utilized in connection with the present inventive package and process. Modifications will become apparent to those of skill in the art after review of this disclosure, and such modifications are deemed to be within the scope of the invention as defined below.

What is claimed is:

1. A vacuum skin package, having a peripheral area and a central area, comprising:

(a) a thermoplastic supporting member;

(b) a thermoplastic heat-formed top web sealed to said supporting member in the peripheral area of the package;

(c) a first moisture-impervious metallic sheet having outer and inner non-heat sealable surfaces;

(d) a second moisture-impervious metallic sheet having outer and inner non-heat sealable surfaces;

(e) the first and second sheets unbonded to each other and substantially enclosing therebetween a product in the central area of the package; and (f) said product and enclosing sheets disposed between and enclosed by the supporting member and top web, the top web in communication with the outer non-heat sealable surface of the first sheet, and the supporting member in communication with but unbonded to the outer non-heat sealable surface of the second sheet.

2. The package of claim 1 where the substantially moisture-impervious material is aluminum foil.

3. The package according to claim 1 wherein the first and second sheets are substantially non-formable.

4. The package according to claim 1 wherein the supporting member is substantially impervious to oxygen.

5. The package according to claim 1 wherein the top web is substantially impervious to oxygen.

6. The package according to claim 1 wherein the first sheet is greater in length, in at least one dimension, than the second sheet.

7. The package according to claim 1 wherein the product enclosed between the first and second sheets is disposed within a pouch.

* * * * *